US006067669A

United States Patent [19]

Peterson et al.

[11] Patent Number: 6,067,669

[45] Date of Patent: May 30, 2000

[54] STRAINER EQUIPPED DRAIN PLUG ASSEMBLY

[75] Inventors: Aaron L. Peterson; Craig S Peterson, both of Salt Lake City, Utah

[73] Assignee: Bathcrest, Inc., Salt Lake City, Utah

[21] Appl. No.: 09/247,965

[22] Filed: Feb. 10, 1999

[51] Int. Cl.[7] ..... E03C 1/262

[52] U.S. Cl. ..... 4/287; 4/288; 4/291; 4/295

[58] Field of Search ..... 4/286, 287, 288, 4/289, 290, 291, 293, 295, 652

[56] References Cited

U.S. PATENT DOCUMENTS

| | | | |
|---|---|---|---|
| 1,720,149 | 7/1929 | Rom | 4/287 |
| 2,021,410 | 11/1935 | Foose | 4/287 |
| 2,296,527 | 9/1942 | Kuhnle | 4/287 |
| 3,428,295 | 2/1969 | Downey et al. | 4/295 |
| 4,160,293 | 7/1979 | Niemann | 4/291 |
| 5,072,461 | 12/1991 | Logsdon | 4/295 |

*Primary Examiner*—Robert M. Fetsuga

[57] ABSTRACT

A drain plug assembly having a strainer removably fitted between a bottom of a drain housing that is to be mounted in the drain of a vessel and a stopper that is mounted to be moved along a central stem between a locked open position permitting flow through the drain housing and strainer and a closed position wherein flow through the drain housing and strainer is blocked.

2 Claims, 2 Drawing Sheets

STRAINER EQUIPPED DRAIN PLUG ASSEMBLY

BRIEF DESCRIPTION OF THE INVENTION

1. Field of the Invention

This invention relates to drain plug assemblies for bath tubs and the like and is particularly concerned with drain plug assemblies that include accessible strainers that will collect hair grease and the like being discharged through the drain plug assemblies.

2. Prior Art

Various types and forms of drain assemblies for bathtubs and the like have been proposed in the past. It is common, for example to use a drain housing in the drain opening of a bathtub together with a plug or stopper that is either independent of the drain housing or connected thereto by a chain, or the like. More recently, replacement drain assemblies have been developed for use in replacing worn or damaged drain units and stopper assemblies in bathtubs. For example, as shown in U.S. Pat. No. 4,720,877, a drain assembly has been developed and is marketed by Watco to replace originally installed drains and stopper assemblies in bathtubs. This replacement drain assembly includes a plug or stopper that is closed to prevent drainage from the bathtub and that is opened to allow flow therethrough. A replacement drain housing has a guide post on which the stopper is moved and means to hold the stopper in the open position until positively closed.

The more recently developed replacement drain assemblies work well and are generally suitable for the purposes intended. However, it has been found that hair, grease and other materials frequently pass through the assemblies to plug and foul the plumbing system for a bathtub in which such assemblies are used.

OBJECTS OF THE INVENTION

Accordingly, it is a principal object of the present invention to provide a replacement drain assembly that will entrap hair, grease and other materials before such materials can get into the plumbing system of a bathtub on which such assembly is used. Other objects are to provide a strainer in the replacement drain assembly that is easily removed and cleaned to remove trapped materials. Another object is to provide a strainer that is suitable for use in various types of replacement drain assemblies having a replacement housing with a guide post on which a plug or stopper is traveled between an open position and a closed position.

FEATURES OF THE INVENTION

Principal features of the replacement drain assembly of the present invention include a replacement housing adapted to be threaded into a bathtub drain opening and having a guide post fixed to the housing and providing a guide for a stopper that is moved between an open position allowing the tub to drain and a closed position wherein flow from the tub is prevented. A strainer is positioned between the stopper and a discharge end of the replacement housing and the strainer is removable for cleaning or replacement without removal of the replacement housing.

Additional objects and features of the invention will become apparent to those skilled in the art to which the invention pertains from the following detailed description and drawings.

THE DRAWINGS

In the Drawings:

FIG. 1 is a top plan view of the invention;

FIG. 2, a vertical sectional view taken on the line 2—2 of FIG. 1 and exploded, for clarity;

FIG. 3, an exploded, perspective view of the strainer of the invention.

DETAILED DESCRIPTION

Figure 1:
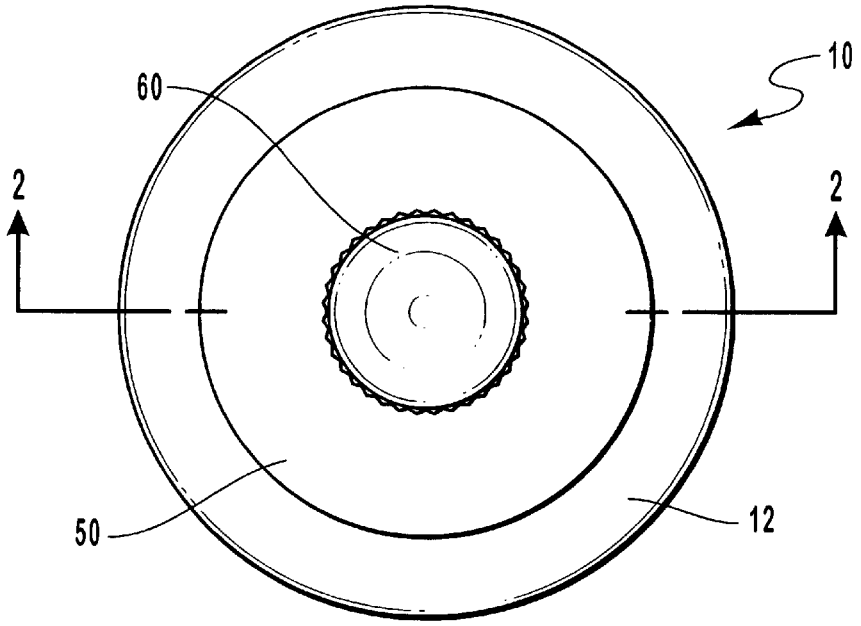
Figure 3:
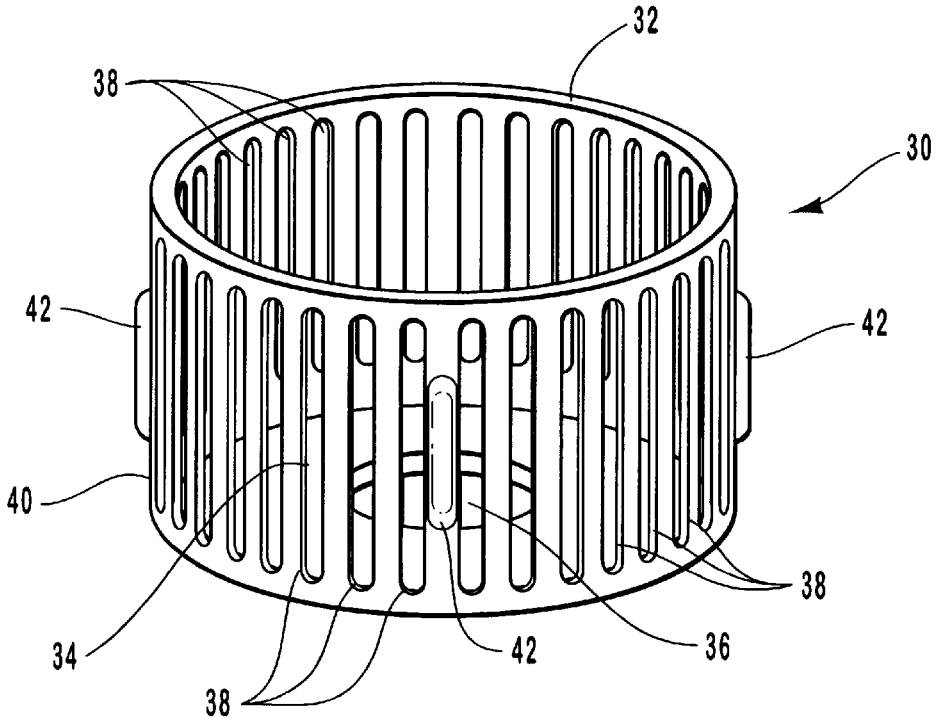
Figure 2:
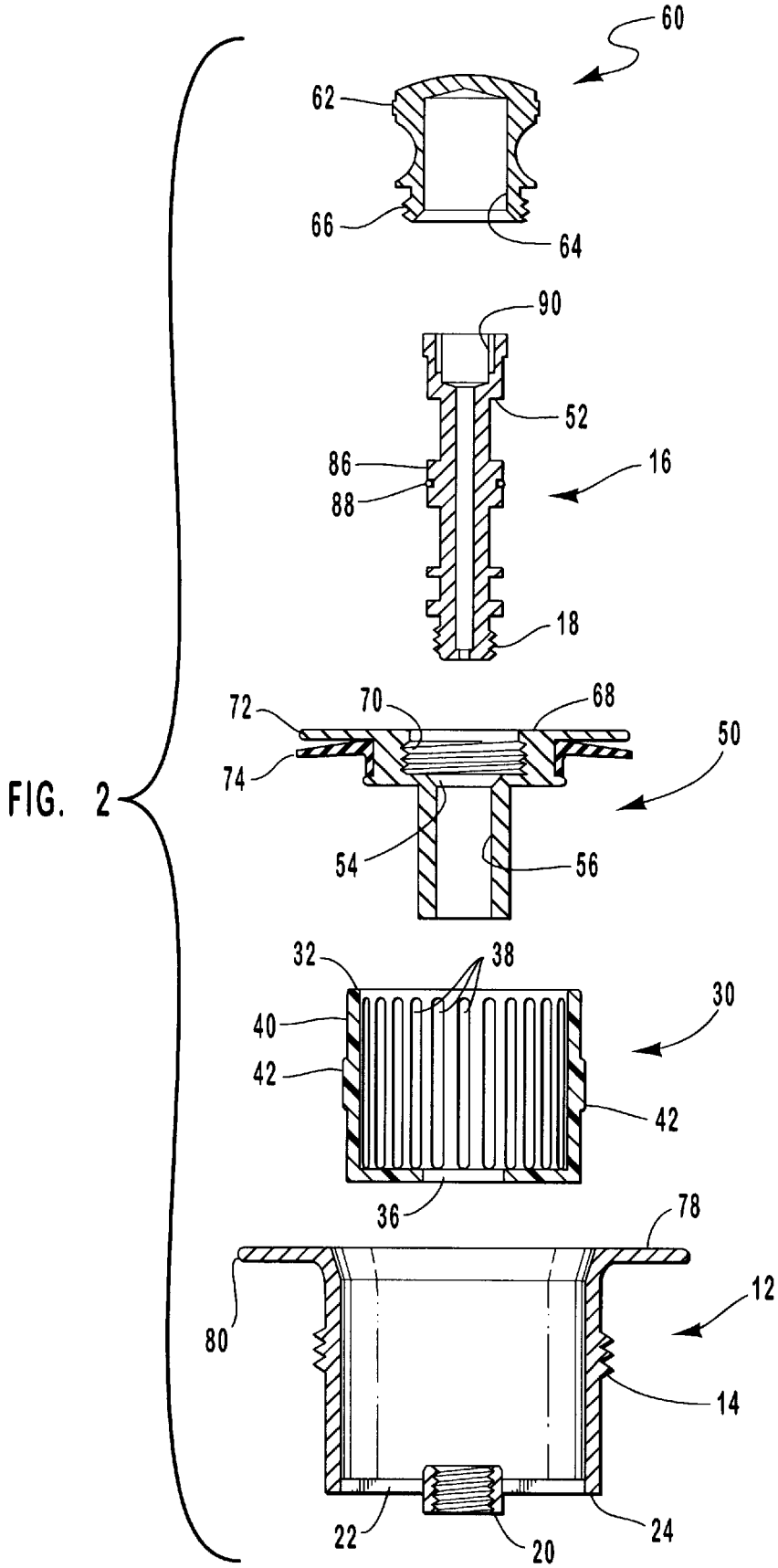

Referring now to the drawings:

In the illustrated preferred embodiment the strainer equipped drain plug assembly of the invention is shown generally at 10.

Drain plug assembly 10 includes a replacement housing 12 that is exteriorly threaded at 14 to be turned into the drain opening of a bathtub, not shown. A rigid stem 16 has one end 18 threaded into an interiorly threaded boss 20 that is supported by a cross head 22 fixed to the discharge end 24 of the replacement housing 12.

A basket shaped strainer 30 is open at a top end 32 and has a bottom 34 with a central hole 36 therethrough. The strainer has spaced, vertically extending elongate slots 38 formed through the cylindrical wall 40 and spacers 42 formed on the exterior surface of the cylindrical wall 40. The strainer fits in the replacement housing with central hole 36 overlying the boss 20 and with spacers 42 engaging the wall of the housing 12. While other types of strainers can be positioned between the stopper and the discharge end of the replacement housing, the basket strainer described is presently preferred since it is easily inserted and removed.

The rigid stem 16 is inserted downwardly through a stopper 50 until a shoulder 52 on the stem engages a shoulder 54 within the bore 56 of the stopper 50. The end 18 of stem 16 is threaded into the boss 20.

Knob 60 has a knurled upper periphery 62 to facilitate gripping by a user and a central blind bore 64 extending into the knob. The lower end 66 of knob 62 is exteriorly threaded to be turned into a top 68 of the stopper 50 at threaded recess 70 and with the stem 16 extending into the blind bore 64.

The stopper 50 has a flange 72 that serves as a backing member for a flexible plastic or rubber valve head 74 that is held between the flange 72 and a collar 76. Valve head 74 seats against a top edge 78 of a flange 80 of the housing 12 to prevent flow through the housing 12 when the housing 12 is installed in a bathtub drain. Lifting on knob 60 will move the valve head 74 away from the housing 12 and will allow flow through the bore of housing 12 and the strainer 30 and through the drain pipe (not shown) connected to the housing 12. Lifting of the knob 60 will also move shoulder 54, inside the stopper 50, past shoulder 86 and a snap-ring 88 surrounding the shoulder 86 on the stem 16. Once the shoulder 54 passes the snap-ring 88 the valve head 74 is held in the open position until knob 60 is pushed to move the shoulder past the snap-ring.

Hair, grease and other materials carried by the discharging water and captured by the strainer 30 does not pass through the strainer to foul or plug the drain pipes connected to the housing 12. To remove the strainer 30 so that it can be cleaned or replaced it is only necessary to turn and manually remove the knob 60 and to then use a screwdriver, with its tip inserted into slots 90 at the top of stem 16 to turn and remove the stem from the housing 12. The stem 16 and stopper 50 are removed to allow the strainer 30 to be lifted from the housing 12. A reverse turning procedure is followed to replace the filter 30 and to replace the stem 16 and knob 60.

The stopper 50 and strainer 30 are attached to and are part of the drain plug assembly. They are not removed during normal filling and draining of the bathtub and are not subject to becoming misplaced and lost.

Although a preferred form of my invention has been herein disclosed it is to be understood that the disclosure is by way of example and that variations are possible without departing from the subject matter coming within the scope of the following claims, which subject matter I regard as my invention.

I claim:

1. A strainer equipped drain plug assembly comprising a replacement housing for threading into an outlet of a bathtub, said housing including an exteriorly threaded cylindrical body, a peripheral flange projecting from a top of said cylindrical body;

a rigid stem fixed to said cylindrical body and projecting centrally up through said body;

a stopper with a valve head, movable along said stem between an open position and a closed position with said valve head seated on said peripheral flange of said replacement housing;

a basket shaped strainer with a hole through a bottom thereof to surround said stem and holes through a sidewall thereof positioned between said stopper and an outlet from said cylindrical body of said replacement housing; and a knob securing said stopper to said stem.

2. A strainer equipped drain plug assembly as in claim 1, wherein the holes through the sidewall of the strainer are vertical and spaced around said sidewall.

* * * * *